United States Patent [19]

Landregan et al.

[11] 4,331,083

[45] May 25, 1982

[54] DROP CENTER GONDOLA CAR

[75] Inventors: Robert J. Landregan, Portland; Gary S. Kaleta, Warren, both of Oreg.

[73] Assignee: FMC Corporation, Chicago, Ill.

[21] Appl. No.: 50,837

[22] Filed: Jun. 21, 1979

[51] Int. Cl.[3] ..... B61D 3/00; B61D 7/00; B61D 17/10

[52] U.S. Cl. ..... 105/406 R; 105/247; 105/416; 105/418; 105/420; 105/421

[58] Field of Search ..... 105/243, 248, 264, 360, 105/364, 404, 406 R, 422, 4 R, 413, 414, 415, 416, 417, 418, 419, 244, 245, 247, 251, 253, 254, 255, 258, 420, 421; 410/56, 57

[56] References Cited

U.S. PATENT DOCUMENTS

| | | | |
|---|---|---|---|
| 810,301 | 1/1906 | Von Philp | 105/264 X |
| 901,413 | 10/1908 | Andrews | 105/406 R |
| 1,154,324 | 9/1915 | Knox | 105/360 |
| 1,248,890 | 12/1917 | Neikirk | 105/244 |
| 1,531,761 | 3/1925 | Seiders | 105/406 R |
| 1,630,001 | 5/1927 | Gardner | 105/406 R |
| 1,962,717 | 6/1934 | Kiesel, Jr. | 105/406 R |
| 2,071,620 | 2/1937 | Filch | 105/243 |
| 2,121,181 | 6/1938 | Bayerl | 410/57 X |
| 2,246,543 | 6/1941 | Smith | 410/57 X |
| 2,513,450 | 7/1950 | Carlisle, Sr. | 105/360 X |
| 2,788,750 | 4/1957 | Priest | 105/406 R |
| 3,240,168 | 3/1966 | Charles et al. | 105/406 R |
| 3,253,556 | 5/1966 | Glasser et al. | 105/406 R |
| 3,376,832 | 4/1968 | Flowers | 105/364 |
| 3,509,829 | 5/1970 | Henriksson et al. | 105/4 R X |
| 3,524,414 | 8/1970 | Johnson et al. | 105/406 R X |
| 3,557,713 | 1/1971 | Spence et al. | 105/404 |
| 3,713,400 | 1/1973 | Teoli | 105/406 R |
| 3,751,102 | 8/1973 | Stoneburner | 105/422 X |
| 3,814,028 | 6/1974 | Adler | 105/422 X |
| 3,817,189 | 6/1974 | Bailey et al. | 105/406 R |
| 3,818,843 | 6/1974 | Lee | 105/414 X |
| 3,841,236 | 10/1974 | Hammonds | 105/404 X |
| 3,921,537 | 11/1975 | Fleshman et al. | 105/248 |
| 3,964,399 | 6/1976 | Miller et al. | 105/406 R |
| 4,024,821 | 5/1977 | Yang | 105/406 R |
| 4,044,690 | 8/1977 | Deeks | 105/406 R X |
| 4,212,252 | 7/1980 | Hart et al. | 105/406 R |
| 4,228,742 | 10/1980 | Przybylinski et al. | 105/248 |
| 4,236,459 | 12/1980 | Teoli | 105/406 R |
| 4,254,714 | 3/1981 | Heap | 105/406 R |

FOREIGN PATENT DOCUMENTS

| | | | |
|---|---|---|---|
| 1089711 | 11/1980 | Canada | 105/406 R |

OTHER PUBLICATIONS

Roberts, Robert; Unit Train Helps Canada Export Coal; Modern Railroads; Nov. 1969.

Bathtub Gondolas for Unit Trains; Railway Locomotives and Cars; Nov. 1969; pp. 26 and 27.

*Primary Examiner*—Joseph F. Peters, Jr.
*Assistant Examiner*—Howard Beltran
*Attorney, Agent, or Firm*—A. J. Moore; R. B. Megley

[57] ABSTRACT

A drop center railway car is provided with a continuous center sill having a depressed portion between the wheel assemblies. The continuous center sill is disposed between a pair of light weight side walls which include side sills that are connected to transverse bolsters for proportionally distributing longitudinal and vertical loads between the two walls and the continuous center sill with the center sill supporting about three-quarters of the longitudinal load. Crossbearers cooperate with the bolsters to prevent injurious bowing of the commodity confining surfaces of the light weight side walls, side sills and bolsters, which light weight is made possible by the forces being proportionally distributed between the three, rather than two, longitudinal members. The drop center portion of the center sill is secured within a flat bottom portion of the car body thus lowering the lowermost cargo supporting surface the maximum amount permitted by government regulations thereby providing a very low center of gravity to the car.

5 Claims, 9 Drawing Figures

DROP CENTER GONDOLA CAR

BACKGROUND OF THE INVENTION

1. Field of the Invention

The present invention relates to railway cars and more particularly relates to a rotary dump gondola car having a continuous center sill with a depressed or drop center portion between the wheel assemblies.

2. Description of the Prior Art

Drop center rotary dump gondola cars are known in the art as evidenced by U.S. Pat. No. 3,713,400 which issued to Teoli on Jan. 30, 1973. This patent discloses a drop center car which includes end stub center sills and box side sills. The drop center portion is formed from a parabolic plate which is attached to the side sills and to end sheets. However, no center sill is provided in the drop center portion, and accordingly the side sills and side walls must support substantially all of the vertical and longitudinal loads applied to the car. Accordingly, the bolsters and side sills must be of rather heavy rigid construction. Also, the parabolic shape of the drop center portion somewhat limits the available space for carrying bulk commodities as compared to a flat bottom wall that extends transversely substantially the full width of the car.

U.S. Pat. No. 1,531,761, Seiders, which issued on Mar. 31, 1925 discloses a gondola car having a continuous center sill disposed within the cargo space and having cross bearers and gussets connecting flat side walls to the center sill. However, the center sill does not include a depressed portion but is positioned in its entirety above the level of the trucks. Accordingly, the car has a high center of gravity, and does not include a drop center portion.

U.S. Pat. No. 3,240,168 which issued on Mar. 15, 1966 to Charles et al discloses a gondola car with a depressed center, or pocket, between the wheels for lowering the center of gravity of the car. The car is also adapted for rotary unloading. This patent discloses cross members which prevent the lateral movement of the side cord. However, the drop center portion of the car does not include a center sill, but instead, relies on external channel stiffeners for supporting the vertical load from the side walls and channel side sills. Thus, the bolsters and channel side sills must be rather sturdy to support the longitudinal and vertical forces applied thereto.

SUMMARY OF THE INVENTION

The drop center railway car of the present invention is provided with a continuous center sill having a depressed or drop center portion to which the upper surface of a flat floor of the drop center portion of the body is welded. The height of the flat floor above the tracks is slightly above the permitted track clearance thereby allowing maximum utilization of available space for a bulk commodity with the center of gravity of the loaded car being as low as possible, the computed center of gravity being 68.2 inches above the top of the rails.

The car is also designed with longitudinally extending walls which include side sills disposed on opposite sides of the center sill and connected to transverse bolsters in such a way as to distribute the longitudinal and vertical loads proportionally between the two side walls and the center sill.

In the preferred embodiment, a railway car is provided which includes a pair of wheel assemblies at opposite ends of the car, a transversely extending bolster operatively supported by each wheel assembly; means defining a continuous center sill having end portions secured to and supported by said bolster and having a drop center intermediate portion disposed below the lowest level of said end portions; and means defining a car body having a floor, side walls, end walls, and a drop center portion between said wheel assemblies; said floor including end portions secured to the upper surface of the end portion of the center sill, and an intermediate flat portion secured to the lower surface of said drop center portion of said center sill, said center sill being adapted to carry a substantial portion of the longitudinal and vertical loads applied to the car.

DESCRIPTION OF THE PREFERRED EMBODIMENT

Figure 1:
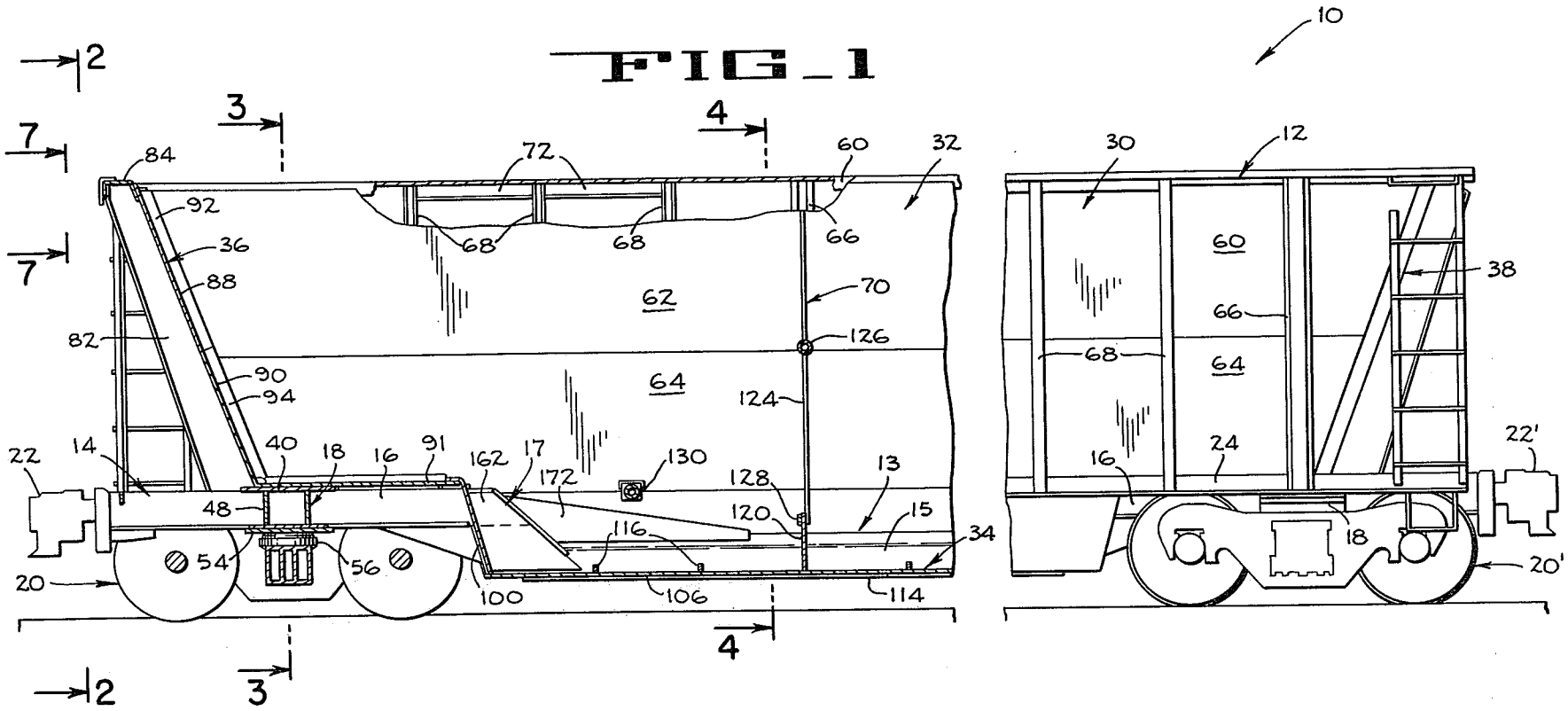
FIG. 1 is a side elevation of the preferred embodiment of the drop center railway car of the present invention, the central portion of the car being cut away, one end portion of the car being shown in longitudinal section taken along lines 1—1 of FIG. 2, and an upper portion of the far wall being cut away to illustrate certain reinforcing members.

The drop center railway car 10 (FIGS. 1 and 2) is illustrated in its preferred embodiment as a rotary dump, gondola car especially suited for handling bulk commodities such as coal, grain, ores of different types, and other similar products which may be dumped into the open top of the car in bulk and dumped from the car by inverting the car by standard well known means.

In general, the car 10 includes a body 12 having a drop center portion 13 and a continuous center sill 14 with a depressed, or drop center, portion 15 secured to raised stub end portions 16 by transition sections 17. The stub end portions 16 of the center sill 14 are secured to bolsters 18 (only one being shown) that extend transversely of the car. The bolsters 18 are operatively supported on wheel assemblies 20,20' of standard design, and the stub end portions 16 of the center sill are connected to adjacent cars by rotary couplings 22,22' (FIG. 1) of standard well known design.

The center sill 14 (FIGS. 1, 3 and 6), the two bolsters 18, a pair of side sills 24,26 which are part of two side walls 30,32, a floor 34, and end walls 36,38 are rigidly all rigidly secured together as by welding.

The above components are specifically designed to distribute longitudinal and vertical forces in proportion to the strength of the center sill 14 which supports about three-quarters of the longitudinal load, the wall 30 and its side sills 24, and the wall 32 and its side sill 26. This proportional distribution of forces to three longitudinal members and the two transverse bolsters, rather than to only two side sills and the bolsters, permit the use of much lighter materials for these components without loss of strength.

Figure 3:
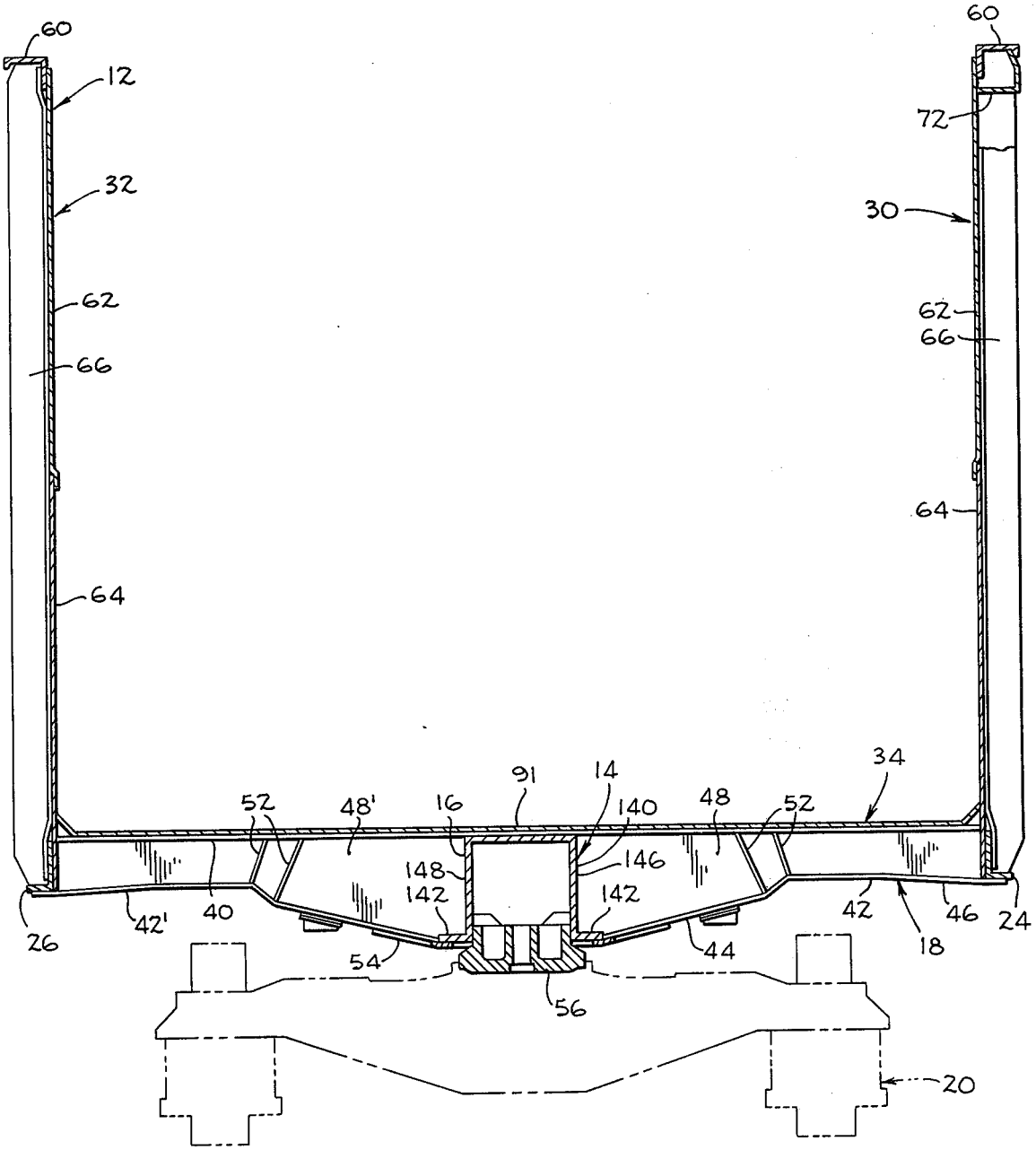
FIG. 3 is a transverse section taken substantially along lines 3—3 of FIG. 1 illustrating one of the bolsters in end elevation and the shape of the car body above one end portion of the center sill and the center plate in central section; an upper portion of one wall being cut away to illustrate a reinforcing member, and a portion of the wheel assembly being shown in phantom.
Figure 6:
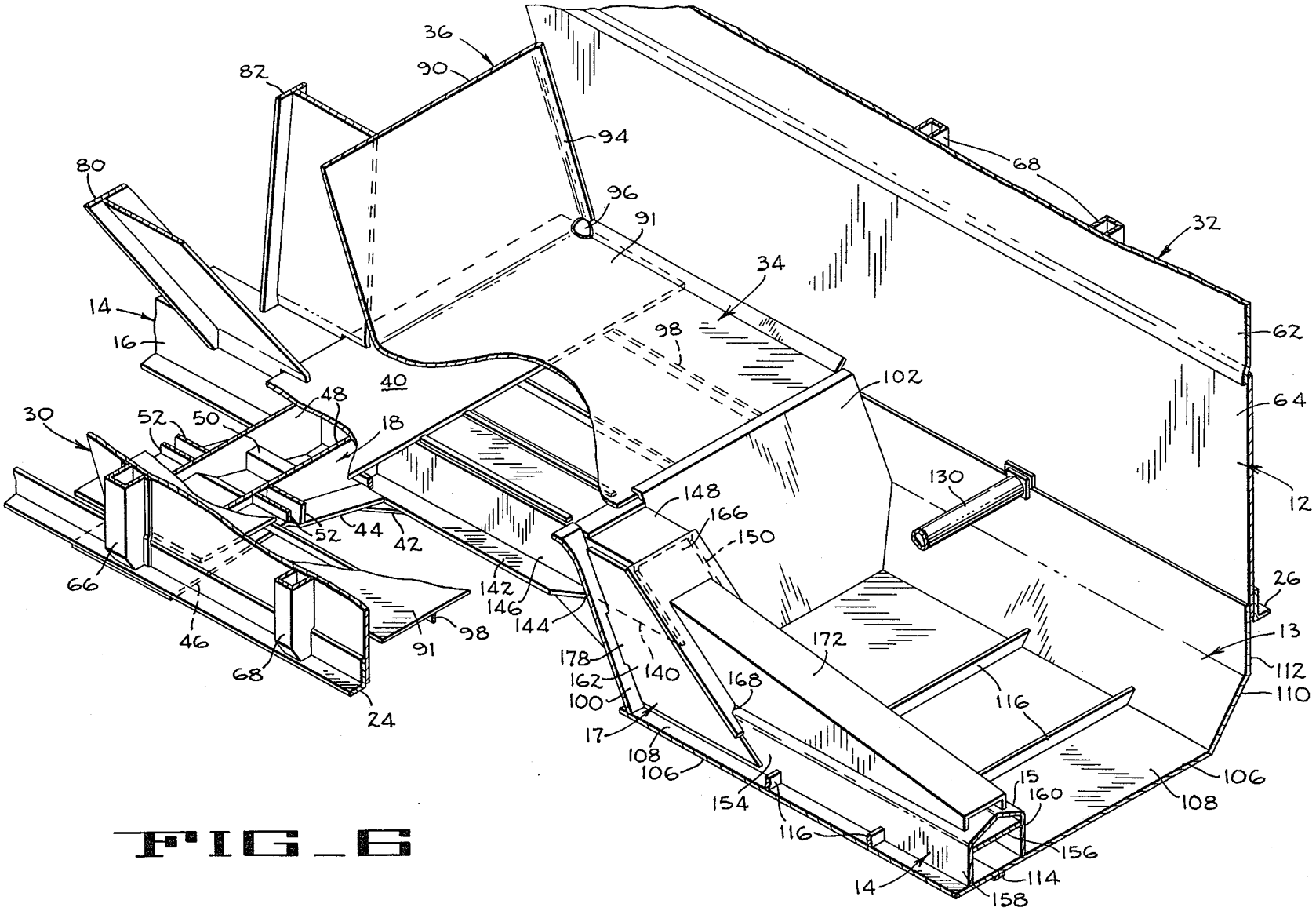
FIG. 6 is a perspective illustrating the transition section of FIG. 5 along with a portion of the car body, portions of one of the rear bolsters and rear walls being cut away to illustrate additional supporting structure.

As best shown in FIGS. 3 and 6, each bolster 18 is rigidly secured to an associated end portion 16 of the continuous center sill 14. Each bolster includes a top plate 40, a pair of bottom plates 42,42', each of which abuts flanges of the associated center sill end portions 16 and include an upwardly and outwardly angled portion 44 integral with a substantially horizontal portion 46 that extends outwardly beyond the ends of the top plate 40 to support the side sills 24,26 and side walls 30,32, respectively. Transverse, vertically extending plates 48,48', a box member 50, and pairs of upright plates 52 are secured between the top plates 40 and bottom plates 42,42' on each side of the center sill. A tie plate 54 (FIG. 3) is connected to both bottom plates 42,42' and to the center sill, and is apertured to receive a well known center plate 56. The above components of each bolster 18 are welded together and to the associated stub end portion 16 of the center sill to provide a rigid, but relatively light weight bolster.

The side walls 30,32, which include the side sills 24,26, respectively, are identical and accordingly only the wall 32 will be described in detail but equivalent components of the wall 30 will be assigned the same numerals as assigned to wall 32.

Figure 4:
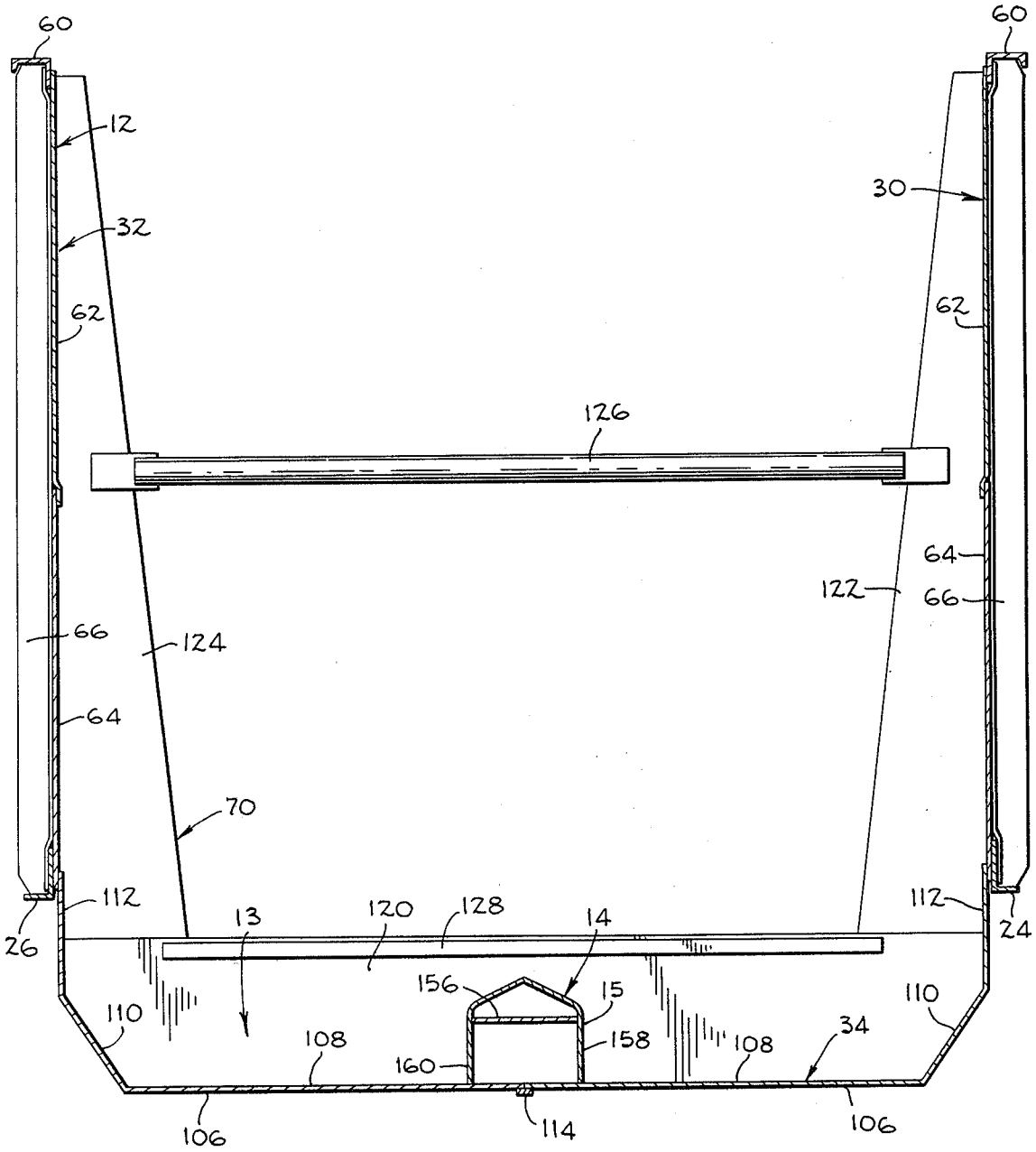
FIG. 4 is a transverse section taken along lines 4—4 of FIG. 1 through the drop center portion and illustrating one of the crossbearers therein.

The side wall 32 comprises a top chord 60 (FIGS. 1 and 4) an upper side sheet 62, a lower side sheet 64, and the associated side sill 26. A plurality of vertically extending side posts 66 and side stiffeners 68 are equally spaced from each other longitudinally of the car. The posts 66 are of hat section and are disposed adjacent the ends of the side walls and also in transverse planar alignment with cross bearers 70 within the cargo area of the car body 12 to provide additional strength in these areas. The stiffeners 68 are interposed between the side posts and are "C" shaped in cross section. As shown in FIG. 3, both the top chord 60 and the associated side sill 26 are of relatively light angle section.

In order to reinforce the portions of the relatively light top chord 60 which engage the dumping mechanism (not shown), top chord angle stiffeners 72 (FIGS. 1 and 3) are interposed between the adjacent vertical stiffeners 68. All of the above side wall components are rigidly secured together as by welding in order to provide strong but light weight walls 30,32.

The end walls 36 and 38 of the car body 12 are identical, and accordingly only the end wall 36 will be described in detail.

Figure 2:
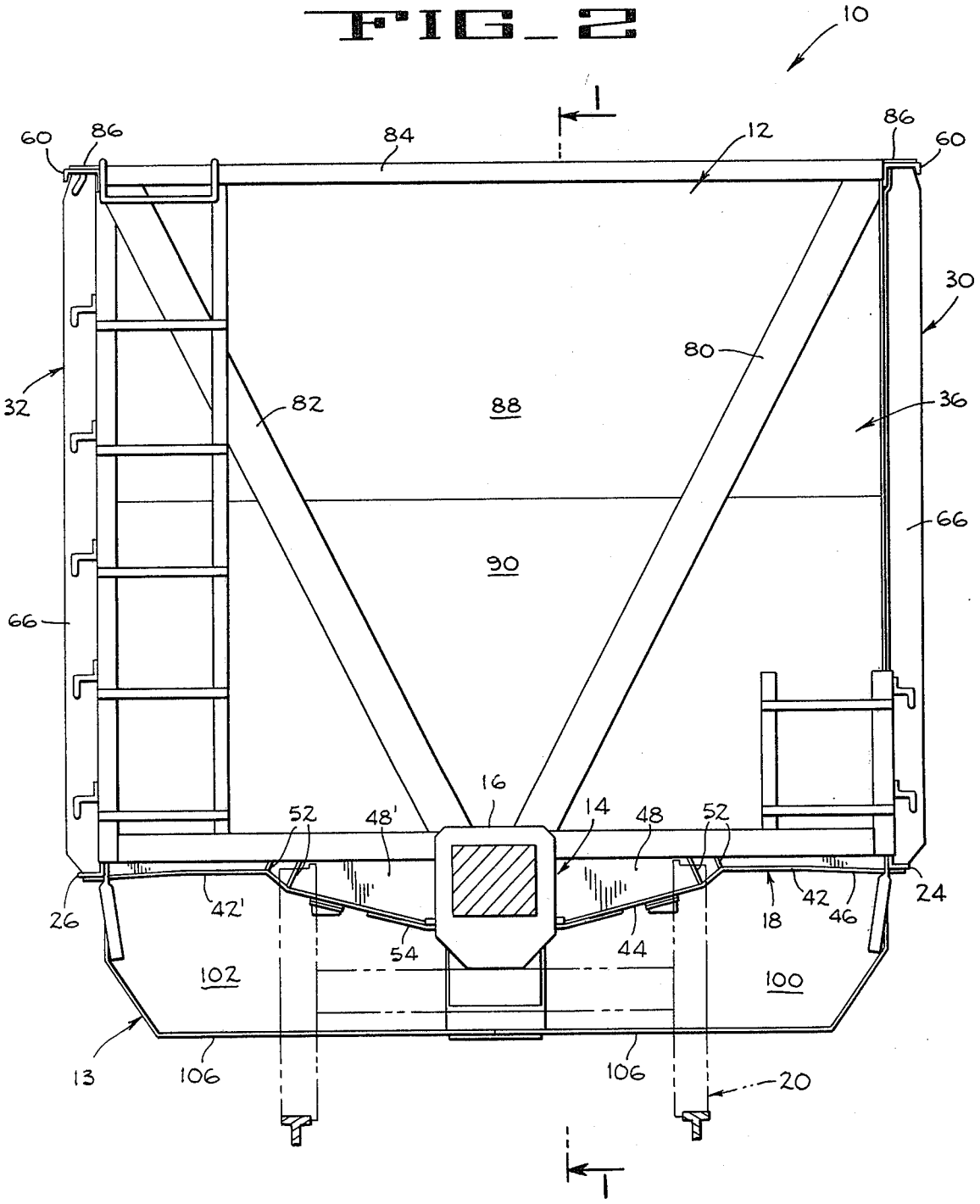
FIG. 2 is an end elevation of the car taken looking in the direction of lines 2—2 of FIG. 1.
Figure 7:
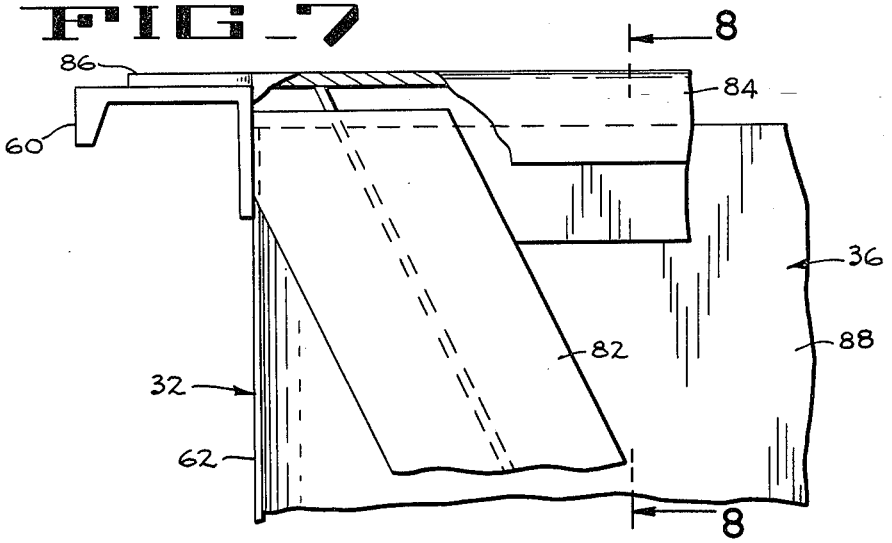
FIG. 7 is an enlarged end view of an upper end corner with parts cut away, said view taken looking in the direction of arrows 7—7 of FIG. 1.
Figure 9:
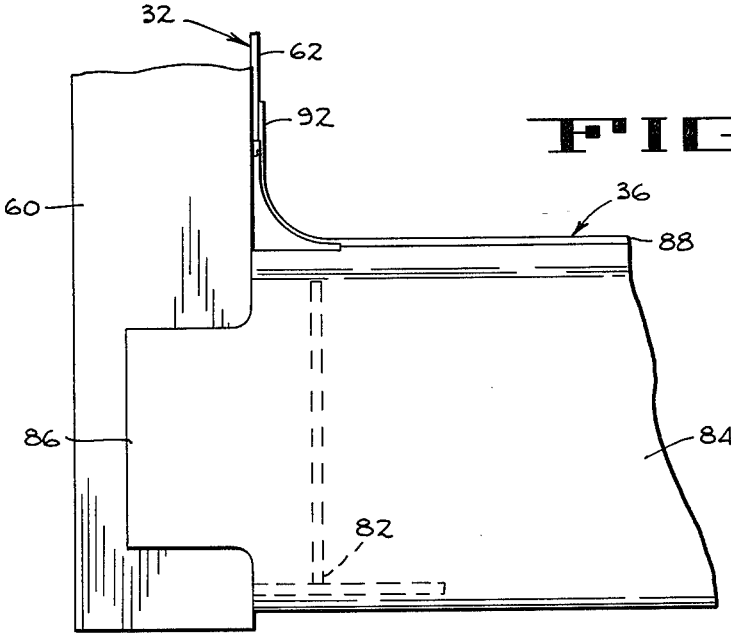
FIG. 9 is a plan illustrating the corner of FIGS. 7 and 8.
Figure 8:
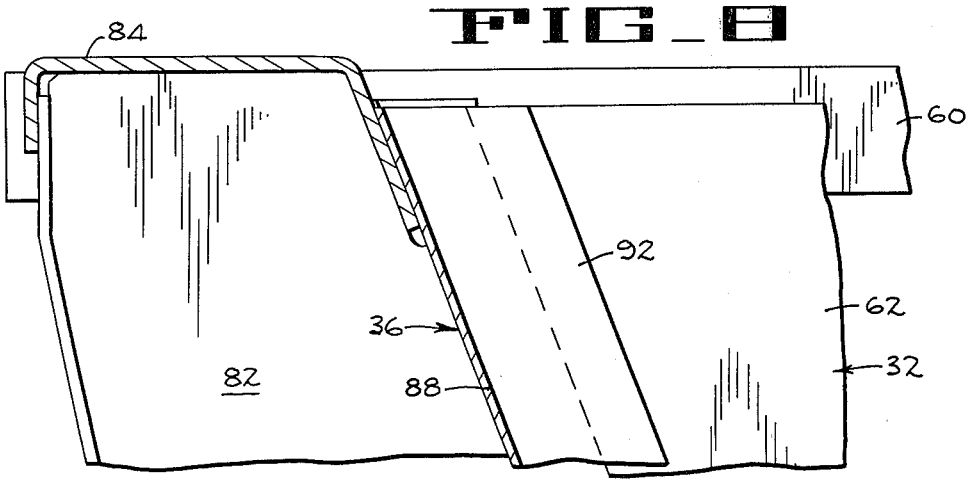
FIG. 8 is a transverse section taken along lines 8—8 of FIG. 7.

The end wall 36 (FIGS. 1, 2 and 6) comprises a pair of fabricated end diagonal supports 80,82 that are T-shaped in cross section and have their lower ends welded to the end sections 16 of the center sill 14. The diagonal supports 80,82 angle outwardly and upwardly relative to the body 12 from the center sill both longitudinally and transversely thereof. As best shown in FIGS. 2 and 7–9 the upper ends of the diagonal supports 80,82 are welded to a generally channel shaped top end chord 84 and to end portions of the top chords 60 of the side walls 30,32. As shown in FIGS. 2, 7 and 8, tabs 86 are provided on both ends of the top end chords 84 and are welded to the upper surface of the top chords of the side walls 30,32.

An upper end wall sheet 88 (FIGS. 1 and 2) and a lower end wall sheet 90, that overlaps the upper sheet, form the commodity confining surface of the end wall 36. A horizontal floor sheet 91 (FIG. 6) of the lower sheet 90 is bent from the upstanding portion to form a portion of the car floor 34 that overlies a part of the center sill stub end portion 16. Narrow side portions 92,94 (FIG. 1) of the sheets 88,90 are bent so as to engage the associated side walls as best illustrated in FIGS. 1 and 6. In order to bend the lower sheet 90 about a transverse axis and also to bend the end portions 92,94 thereof about longitudinal axes, a segment is cut from each side edge of the lower sheet and a patch 96 is welded over each opening to provide a leak proof body 12. The above described components of the end wall 36 are rigidly interconnected to each other, and to the center sill end portion 16, to the bolster 18 and to the side walls 30,32 as by welding.

The floor 34 (FIG. 6) of the car body 12 includes the above mentioned horizontal floor sheet 91, and a similar horizontal sheet (not shown) at the other end of the car. Both of these horizontal floor sheets are reinforced by transversely spaced longitudinally extending bars 98, two of which are secured to the top of the associated stub end portions of the center sill, while others are welded to the associated bolster 18 and to the outside surfaces of inclined drop center end walls 100,102 that are disposed on opposite sides of the center sill 14 as best shown in FIG. 6. The inclined end walls 100,102 and similar inclined end walls located near the other end of the car 10 form a part of the commodity supporting portion of the drop center section 13 of the body 12.

The drop center section 13 (FIGS. 4 and 6) of the body 12 also includes a pair of longitudinally extending bottom sheets 106 each of which has a horizontal floor section 108, and upwardly inclined transition sections 110 and a vertical edge section 112. The vertical edge sections 112 are welded to the associated walls 30,32; and the inner edges of flat bottomed portions are positioned adjacent to or abutted against each other at the longitudinal axis of the vehicle. The horizontal floor sections 108 are welded to the bottom surface of the drop center portion 15 of the center sill 14 and extend substantially the full length and width of the drop center section. The inner edges of the flat bottom portions 108 are connected to each other by welding a longitudinal strap 114 to the lower surface thereof. The horizontal floor sections 108 and strap 114 when connected together and to the lower surface of the drop center portion 15 of the center sill define a horizontal floor with a substantially planar lower surface with no reinforcing structure therebelow.

Opposite ends of the two sheets 106 are welded to the adjacent edges of the aforementioned inclined plates 101,102 at the adjacent ends of the drop center portion. As best shown in FIGS. 1 and 6, a plurality of narrow transversely extending straps 116 are disposed inside the drop center section 13 and are welded to the drop center portion 15 of the center sill 14, to the flat floor portions 108 and to the transition portion 110 to resist bowing of the flat floor portion. The cross bearers 70 (FIGS. 1 and 4) also aid in supporting the floor sections 108. Two of the crossbearers 70 are provided for the preferred 105 ton, 4200 cubic foot car which is 50 feet long and about 10½ feet wide.

Each crossbearer 70 (FIGS. 1 and 4) includes a vertical plate 120 welded to the drop center portion 15 of the center sill 14, to the bottom sheets 106, to the inclined transition sections 110, and to the vertical sections 112 of the two bottom sheets 106. A pair of vertical side plates 122 and 124 are welded to and extend upwardly from the plate 120. The side plates 122,124 are welded to the inside surfaces of the side walls 30,32, respectively, in transverse alignment with side posts 66 as best shown in FIG. 1. A transversely extending bar 126 is connected to the plates 122,124 thereby maintaining the side walls 30,32 in their preferred parallel positions relative to each other. A strap 128 is welded to the upper edge of the plate 120 to prevent bending of the same when the bulk commodity product is loaded into the body 12.

In addition to the tie bars 126 minimizing spreading of the side walls 30 and 32, a plurality of lower tie bars 130 (only one being shown in FIGS. 1 and 6) are rigidly secured to the inside surface of the side walls 30 and 32 in horizontal alignment with the side sills 24 and 26. In the illustrated car, which is a 50 foot car, four of the tie bars 130 are provided.

An important feature of the invention is the provision of the continuously center sill 14 with its drop center portion 15 constructed so that approximately three-quarters of the longitudinal loads, and a portion of the vertical loads are supported by the center sill thus reducing the strength requirements (and also the weight and cost) of the bolsters 18 and side walls 30,32 including their side sills 24,26. In order to provide a center sill having a drop center portion, it is necessary that the two transition sections 17 be designed to absorb rather severe longitudinal loads without damage, and without adding much weight to the center sill construction.

The transition sections 17 (FIGS. 5 and 6) are identical, and each comprises an inverted U-shaped end section 140 of the associated stub center sill 16, which end section has its bottom flanges 142 removed as indicated at 144 to define the inverted U-shaped section. The U-shaped section 140 includes parallel side walls 146,148 and a tapered inner edge 150 that defines an angle X (FIG. 5) that is within the range of about 30° to 50°, preferably 40°, relative to the longitudinal axis of the center sill 14.

The transistion section 17 also includes an adjacent end section 154 of the drop center portion 15 of the center sill. As best shown in FIG. 6, the drop center portion of the center sill is of generally gabled configuration with a stiffening plate 156 welded to parallel side walls 158,160 near the base of the gable. The end section 154 of the drop center sill 15 is positioned below the end section 140 of the associated stub center sill 16 with the outer surfaces of said walls 158,160 being in planar alignment with side walls 146,148. The outer end of the drop center portion 15 defines an angle Y (FIG. 5) that is within the range of about 60° to 70°, preferably about 65° relative to the horizontal axis of the center sill. The steeper angle of the drop center sill end portion corresponds to the angle of the end walls 100,102 thus providing additional cargo space while also providing sufficient clearance for the wheel assemblies 20,20'.

A pair of generally triangular center sill gussets 162 (only one being shown) are welded to the aligned walls 146,148 and 158,160. A center sill floor plate 166 having a complementary gable shaped configuration at its lower end 168 is fitted over and welded to the upper surface of the gable shaped drop center portion 15; and also to the inclined edges of the gussets 162, to the walls 146,148 and to the top wall of the associated stub center end sill 15. Similarly, an inclined end plate 170 (FIG. 5) is welded to the outer inclined edges of the drop center portion 15 of the center sill, to the bottom of the end section 140 of the stub sill section and to the drop center end walls 100,102 of the drop center portion 13 of the body 12.

Figure 5:
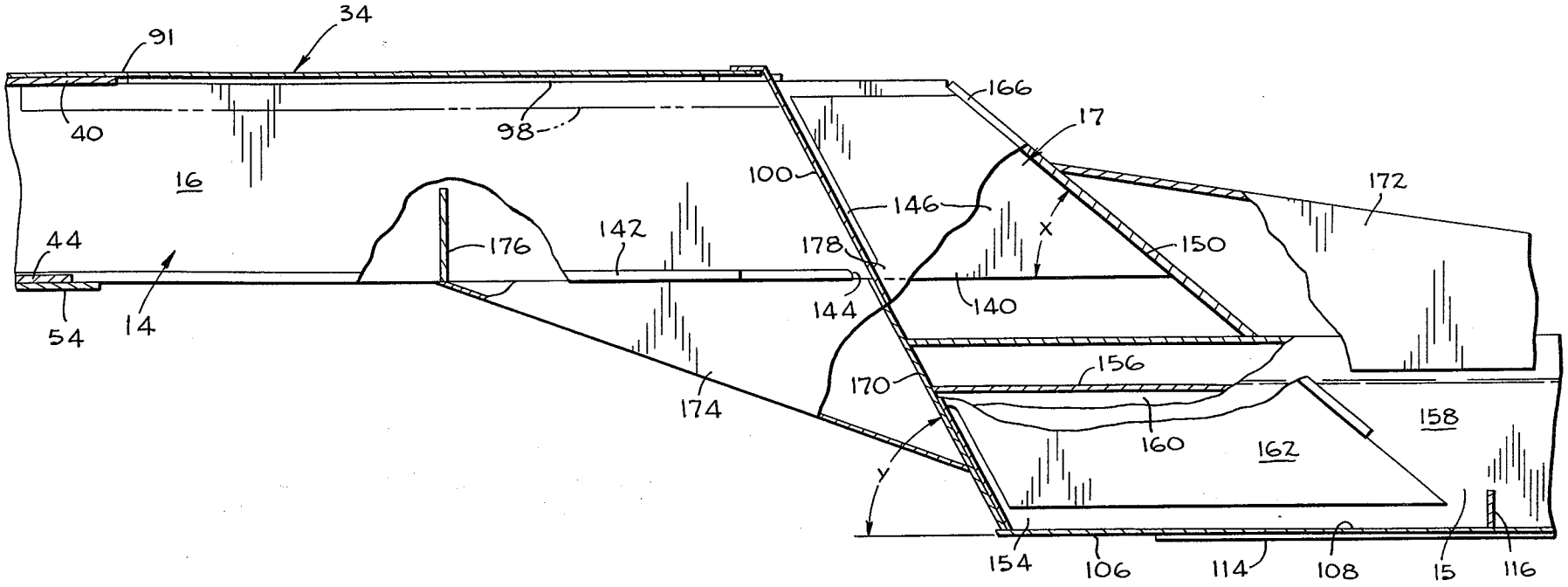
FIG. 5 is an enlarged longitudinal section of one of the center sill transition sections illustrated in FIG. 1, certain parts being cut away and other parts being shown in section.

In order to better withstand the longitudinal loads acting on the center sill 14, a generally triangular inboard gusset 172 of U-shaped cross section is welded to the upper surface of the drop center portion 15 of the center sill 14, and to the center sill floor plate 166. Similarly, a generally triangular outboard gusset 174 of generally U-shaped cross-section is welded to the end plate 170, to the lower surface of the associated stub center sill 16, and to a transverse stiffening plate 176 that is welded inside the associated stub center sill 16 as illustrated in FIG. 5. It will also be noted that the triangular gusset plates 162 each includes a foot 178 which abuts the associated drop center end wall 100 and 102 of the drop center portion of the body 12. The abutment feet 178 thus absorbs compressive loads directly, and accordingly does not rely on welds for this function.

The operation of the drop center railway car 10 of the present invention is the same as other similar railway cars in that the car must withstand rather large longitudinal loads especially when starting and stopping movement of the train to which the car is connected. Also, in its preferred embodiment as a rotary dump gondola car, the railway car must withstand the forces applied thereto when carrying a bulk commodity and also when rotated to dump the commodity from the open top of the car.

The railway car, however, differs from the prior art cars in that the vertical and longitudinal loads are distributed in proportion between the continuous center sill and the two side walls each of which includes a light weight side sill. Also, the bottom of the drop center portion of the body of the car is defined by a substantially flat horizontal section that is reinforced internally of the body rather than externally and is disposed substantially at the minimum permissible clearance above the tracks thereby providing a stable car having a very low center of gravity.

From the foregoing description it is apparent that the railway car of the present invention includes a continuous center sill having a drop center portion which supports approximately three-quarters of the longitudinal load, and a portion of the vertical loads thus permitting the use of lighter bolsters and side walls including their side sills. The car is also provided with a horizontal drop center floor between the wheel assemblies which extend substantially the full width and length of the drop center portion of the car. The drop center floor includes no external bracing, and is disposed as close as permitted to the tracks thereby providing a car with a very low center of gravity.

Although the best mode contemplated for carrying out the present invention has been herein shown and described, it will be apparent that modification and variation may be made without departing from what is regarded to be the subject matter of the invention.

We claim:

1. In a railway car, a drop center sill comprising a pair of spaced stub center sill end portions, a drop center intermediate portion, and means defining transition sections connecting said stub center sill end portions to said drop center intermediate portion of said center sill for providing a center sill having sufficient strength to accommodate about three-quarters of longitudinal loads acting on the car, each transition section comprising a pair of generally trapezoidal gussets rigidly secured to side walls of one of said stub center sill portions and said drop center portions of said center sill; a floor plate rigidly secured to an inner end of said one center sill portion, to said drop center portion, and to said trapezoidal gussets; an elongated U-shaped inboard gusset extending longitudinally of said center sill and rigidly secured between said floor plate and said drop center portion of said center sill; an outboard end plate rigidly secured to outer edges of said drop center portion and to said stub center sill, and an elongated generally U-shaped outboard gusset extending longitudinally of said center sill and rigidly secured between said outboard end plate and one of said stub center sill end portions.

2. A railway car having a low center of gravity when fully loaded comprising: a pair of wheel assemblies on opposite ends of the car; means defining a continuous center sill having stub end portions of predetermined vertical thickness supported by said wheel assemblies and a drop center intermediate portion having a lower surface; and means defining a drop center car body including interconnected side walls, end walls, and a floor; said floor including end portions secured to an upper surface of said stub end portions and a thin central portion defined by at least one planar load engaging floor plate rigidly secured to the lower surface of said drop center portion and extending horizontally substantially full length and width of said drop center portion of said car body in a plane substantially at a level of said lower surface, said planar load engaging floor plate being at least twice the vertical thickness of said end portions of said center sill below the level of said floor end portions; said center sill including means defining transition sections connecting said stub center sill end portions to said drop center intermediate portion of the center sill for providing a center sill having a sufficient strength to accommodate about three-quarters of the longitudinal loads acting on the car.

3. An apparatus according to claim 2 wherein each transition section comprises a pair of generally trapezoidal gussets rigidly secured to side walls of one of said stub center sill portions and said drop center portion of said center sill; a floor plate rigidly secured to an inner end of said one center sill portion, to said drop center portion, and to said trapezoidal gussets; an elongated generally U-shaped inboard gusset extending longitudinally of said center sill and rigidly secured between said floor plate and said drop center portion of said center sill; an outboard end plate rigidly secured to outer edges of said drop center portion and to said stub center sill, and an elongated generally U-shaped outboard gusset extending longitudinally of said center sill and rigidly secured between said outboard end plate and said one stub center sill inner end portion.

4. In a drop center railway car having a low center of gravity when fully loaded; a pair of longitudinally spaced wheel assemblies; a light weight transversely extending bolster operatively connected to each wheel assembly; a continuous center sill rigidly secured at a mid point of each bolster and including stub end portions of predetermined vertical thickness disposed over said wheel assemblies and a drop center intermediate portion rigidly secured between said stub end portions and disposed at a lower level than said stub end portions; said stub end portions and said drop center portion each having an upper and a lower surface having a distance between said upper surface of said end portions and the lower surface of said drop center portion being at least twice the vertical thickness of the center sill stub end portions, means defining a pair of longitudinally extending side walls including side sills secured to end portions of said bolsters; means defining end walls secured to said side walls; and means defining a floor having end portions and a thin center portion rigidly secured to and supported by said side walls and said center sill with the end portions of said floor being over said wheel assemblies and resting upon and secured to the upper surface of said stub end portions of said center sill, and with the center portions of the floor between said wheel assemblies being rigidly secured directly to the lower surface of said drop center portion of said center sill, said center portion of the floor including the planar horizontal load engaging section that extends substantially the full length and width of the drop center portion of the car and is disposed at an elevation substantially equal to a minimum permitted clearance between said drop center car portion and a car supporting surface: the improvement which comprises means defining transition sections connecting said stub end portions to said drop center intermediate portion of said center sill for providing a center sill having sufficient strength to accommodate about three-quarters of the longitudinal loads acting on the car; each transition section comprising a pair of generally trapezoidal gussets rigidly secured to said walls of one of said stub center portions and said drop center portion of said center sill; a floor plate rigidly secured to an inner end of said one center sill portion, to said drop center portion, and to said trapezoidal gussets; an elongated generally U-shaped inboard gusset extending longitudinally of said center sill and rigidly secured between said floor plate and said drop center portion of said center sill; an outboard end plate rigidly secured to outer edges of said drop center portion and to said stub center sill, and an elongated generally U-shaped outboard gusset extending longitudinally of said center sill and rigidly secured between said outboard end plate and one said stub inner end portion of said center sill.

5. In a railway car having a low center of gravity when fully loaded; a pair of wheel assemblies at opposite ends of the car, means defining a continuous center sill having stub end portions operatively connected to and supported by said wheel assemblies and a drop center intermediate portion disposed at a level entirely below said stub end portions, said stub end portions of said center sill each having an upper surface and a lower surface and said drop center portion having a lower surface, and means defining a car body with a drop center portion between said wheel assemblies; said body including a floor, side walls, and end walls; said floor including end portions secured to the upper surface of the stub end portions of the center sill; and a thin intermediate portion rigidly secured to the lower surface of said drop center portion of said center sill; said intermediate portion of said floor including a horizontal load engaging portion disposed at a level below the lower surface of said drop center portion of said center sill, extending substantially the full width of the car, extending substantially the full length of the drop center portion of the center sill, and defining the lowermost portion of said car body means; said horizontal load engaging intermediate portion of the floor also being at least twice the vertical thickness of said drop center portion of said center sill below the level of said floor end portions, said center sill being adapted to carry a substantial portion of longitudinal and vertical forces applied to the car; the improvement which comprises means defining transition sections connecting said stub center sill end portions to said drop center intermediate portion of said center sill for providing a center sill having sufficient strength to accommodate about three-quarters of the longitudinal forces acting on the car: each transition section comprising a pair of generally trapezoidal gussets rigidly secured to side walls of one of said stub center sill portions and said drop center portion of said center sill; a floor plate rigidly secured to an inner end of said one center sill portion, to said drop center portion, and to said trapezoidal gussets; an elongated generally U-shaped inboard gusset extending longitudinally of said center sill and rigidly secured between said floor plate and said drop center portion of said center sill; an outboard end plate rigidly secured to outer edges of said drop center portion and to said stub center sill, and an elongated generally U-shaped outboard gusset extending longitudinally of said center sill and rigidly secured between said outboard end plate and said one stub center sill inner end portion.

* * * * *